United States Patent [19]

Sarfati

[11] Patent Number: 4,645,134

[45] Date of Patent: Feb. 24, 1987

[54] THREAD STORAGE AND FEED DEVICE

[75] Inventor: Alberto G. Sarfati, Como, Italy

[73] Assignee: Sobrevin Société de brevets industriels-Etablissement, Vaduz, Liechtenstein

[21] Appl. No.: 760,719

[22] Filed: Jul. 30, 1985

[30] Foreign Application Priority Data

Aug. 8, 1984 [DE] Fed. Rep. of Germany ..... 3429219

[51] Int. Cl.[4] ..... B65H 51/20

[52] U.S. Cl. ..... 242/47.01; 242/47.12

[58] Field of Search ..... 242/47.01, 47.12, 47.02, 242/47.03, 47.04, 47.05, 47.06, 47.07, 47.08, 47.09, 47.1, 47.11, 47.13, 47; 139/452; 66/132 R

[56] References Cited

U.S. PATENT DOCUMENTS

| | | | |
|---|---|---|---|
| 3,791,598 | 2/1974 | Vischiani et al. | 242/47.12 |
| 3,955,769 | 5/1976 | Kajiura et al. | 242/47.01 |
| 3,957,217 | 5/1976 | Clemens | 242/47.01 |
| 3,971,522 | 7/1976 | Pfarrwaller | 242/47.01 |
| 3,994,447 | 11/1976 | Sarfati et al. | 242/47.12 |
| 4,478,375 | 10/1984 | Sarfati et al. | 242/47.01 |

*Primary Examiner*—Stanley N. Gilreath
*Attorney, Agent, or Firm*—Martin A. Farber

[57] ABSTRACT

A thread storage and feed device having a winding body (9) to which the thread (F) passes in the region of a conical widened portion (17) in order to form a supply which can be withdrawn overhead, arms (24) being arranged crosswise to the angular channel (16) of the conical widened portion (17), which arms extend into slots (30) in the region of the conical widened portion (17) of the winding body (9) and are directed towards corners of a polygon. So that, in the case of high thread output capacity, an orderly large supply of thread can be stored even in the case of very different, and particularly elastic, threads, each of the arms (24) which extend approximately over the axial length of the winding body (9) and are longitudinally displaceable in axial direction forms, at its end facing the angular channel (16), an angular channel (28) of its own, the region (29) of which can be introduced into the slot (30) by the longitudinal displacement.

10 Claims, 12 Drawing Figures

FIG. 1
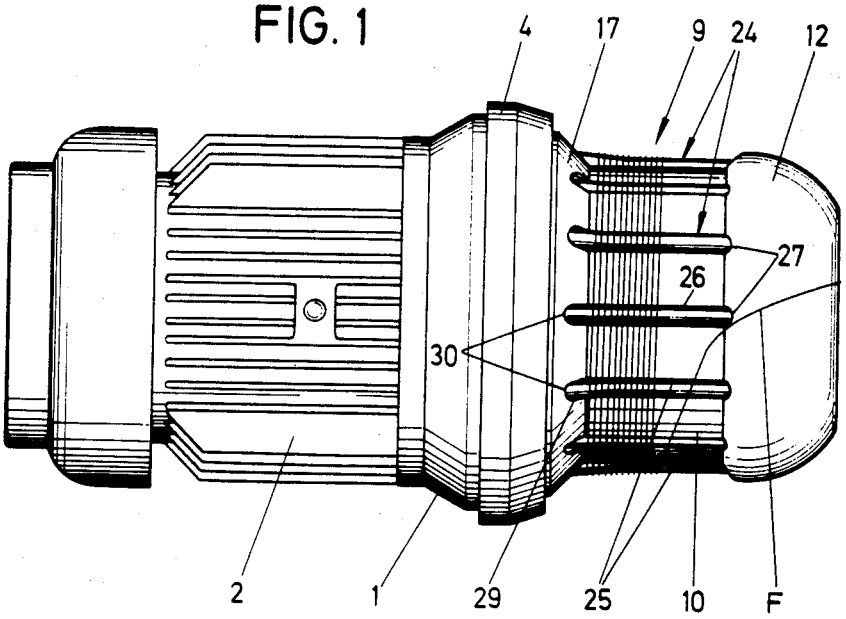
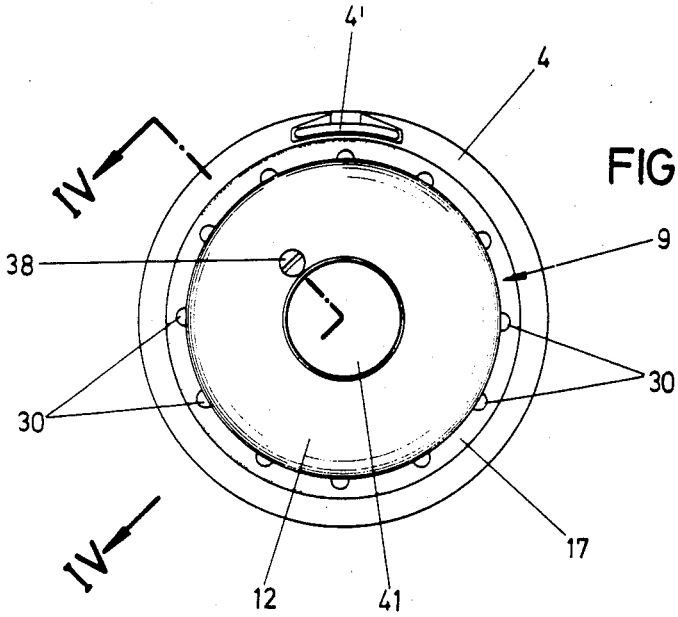
FIG. 2

THREAD STORAGE AND FEED DEVICE

FIELD AND BACKGROUND OF THE INVENTION

The present invention relates to a thread storage and feed device having a winding body to which the thread is fed to form a supply which is removable overhead in the region of a conical widened portion, arms being arranged cross-wise to an angular channel of the conical widened portion, said arms extending into slots in the region of the conical widened portion of the winding body and being directed towards corners of a polygon.

In the known thread storage and feed devices of this kind (Federal Republic of Germany Pat. No. 2 417 440) arms are provided cross-wise to an angular channel between the conical widened portion and the adjacent cylindrical winding body. Adaptation to the yarn to be used is effected by displacing said arms. However, with the increasing output of looms difficulties in withdrawal can arise in the case of highly elastic threads.

From Federal Republic of Germany OS 2 035 754 there is furthermore known a polygonal winding body which consists of four arms arranged at equal angles apart and with which there is associated a controlled active push surface which follows behind the thread feed point. In this case also, the working of highly elastic threads results in withdrawal problems when the looms to be supplied operate with high thread capacity.

SUMMARY OF THE INVENTION

The object of the present invention is to so develop a thread storage and delivery device of this kind, in a manner simple to manufacture, that, with high thread capacity, an orderly large supply of thread can be stored, even with very different elastic threads, in particular.

According to the invention, each of the arms which extend approximately over the axial length of the winding body and are longitudinally displaceable in axial direction, forms, at the end thereof facing the angular channel, on its part an angular channel of its own, a portion of which can be introduced into the slot by the longitudinal displacement.

As a result of this development, a thread storage and feed device of increased utility is created. Optimum adaptation to the most different grades of yarn is obtained. Even if highly elastic threads are stored and a high output capacity is required, an orderly large supply of thread can be stored on the storage body. There is no danger of layers of yarn coming over one another upon a sudden withdrawal, in view of the particularly favorable advance of the thread towards the withdrawal end. Upon its application, the thread first of all comes onto the conical widened portion and then onto the arms lying cross-wise to it, the regions of the conical widened portion between the arms acting to push the applied threads forward. On arms the threads slide towards the withdrawal end. As a result of the arms extending over the entire axial length of the winding body, the thread need not be transferred from a polygonal body onto a cylindrical body. The pushing forward of the thread courses is optimalized by the arms, which themselves form an angular channel. This means that the corresponding region has a greater inclination than the remaining region. The region with the greater inclination opposes the displacement of the layers of thread. If, in particular, highly elastic threads are processed with large output capacity, this corresponding region goes into action. On the other hand, if the elasticity of the threads to be worked decreases, then the angular-channel region of the arms can be brought partially or completely into the slot, thereby obtaining different winding and feeding conditions.

One advantageous further feature is that the slot-side end of the arms is adjustable in radial direction. The angular-channel region of the arms can, accordingly, be adjusted to a greater or lesser inclination, depending on the grade of yarn to be worked. At the same time, however, the inclination of the arms themselves also changes. This means that, with increasing inclination of the angular-channel regions, the inclination of the arms also increases, in combination with a better downward sliding of the threads, which is advantageous, in particular, in the case of highly elastic threads.

In addition to this, it is advantageous for the withdrawal-side end of the arms to be mounted swingably on the winding body and for the section of the arms facing said end to extend approximately parallel to the circumferential wall, developed as a drum, of the winding body. The sliding conditions change accordingly when the arm swings around the withdrawal-side end of the winding body.

In this connection, it is favorable for the parallel-extending section to lie partially in grooves in the drum wall, said grooves extending from the slots. In this way, the conical widened portion and the surrounding wall can be made in one piece.

The withdrawal of the thread is facilitated by the ends of the parallel arms extending into a somewhat bulged annular-head surface of the winding body. The thread is withdrawn, if necessary, on the top over this annular head surface.

A simple longitudinal displacement of the arms can be effected by a setting screw in the center of the head surface of the winding body, which screw produces the longitudinal displaceability.

It then is advantageous to provide an additional screw for the adjustment of the arms in radial direction, which screw is accessible from the head surface of the winding body. This adjustment is advisable when a large spectrum of threads is to be worked. However, if the same threads are worked at all times, such additional displacement could be dispensed with. The arms would then have to be imparted their proper inclination already at the time of the manufacture of the thread storage and feed device.

Structural advantages result from the fact that the webs are seated collectively and swingable against spring action on a bushing which is arranged for longitudinal displacement within the winding body and that they rest on the fingers of a sleeve which is concentrically displaceably disposed on the bushing. Upon the displacement of this sleeve, which is effected by means of the additional screw, the radial displacement of the arms can be effected. Upon a displacement of the bushing alone, only the axial displacement of the arms takes place.

By experiments it has been found advantageous for the size of the angular channel of the arms to be about 176° and that of the conical widened portion surface about 45°.

One embodiment of the invention will be exlained below with reference to FIGS. 1 to 12 of the drawing, in which:

FIG. 1 is an elevational view of the thread storage and feed device;

FIG. 2 is an end view of the thread storage and feed device;

Figure 3:
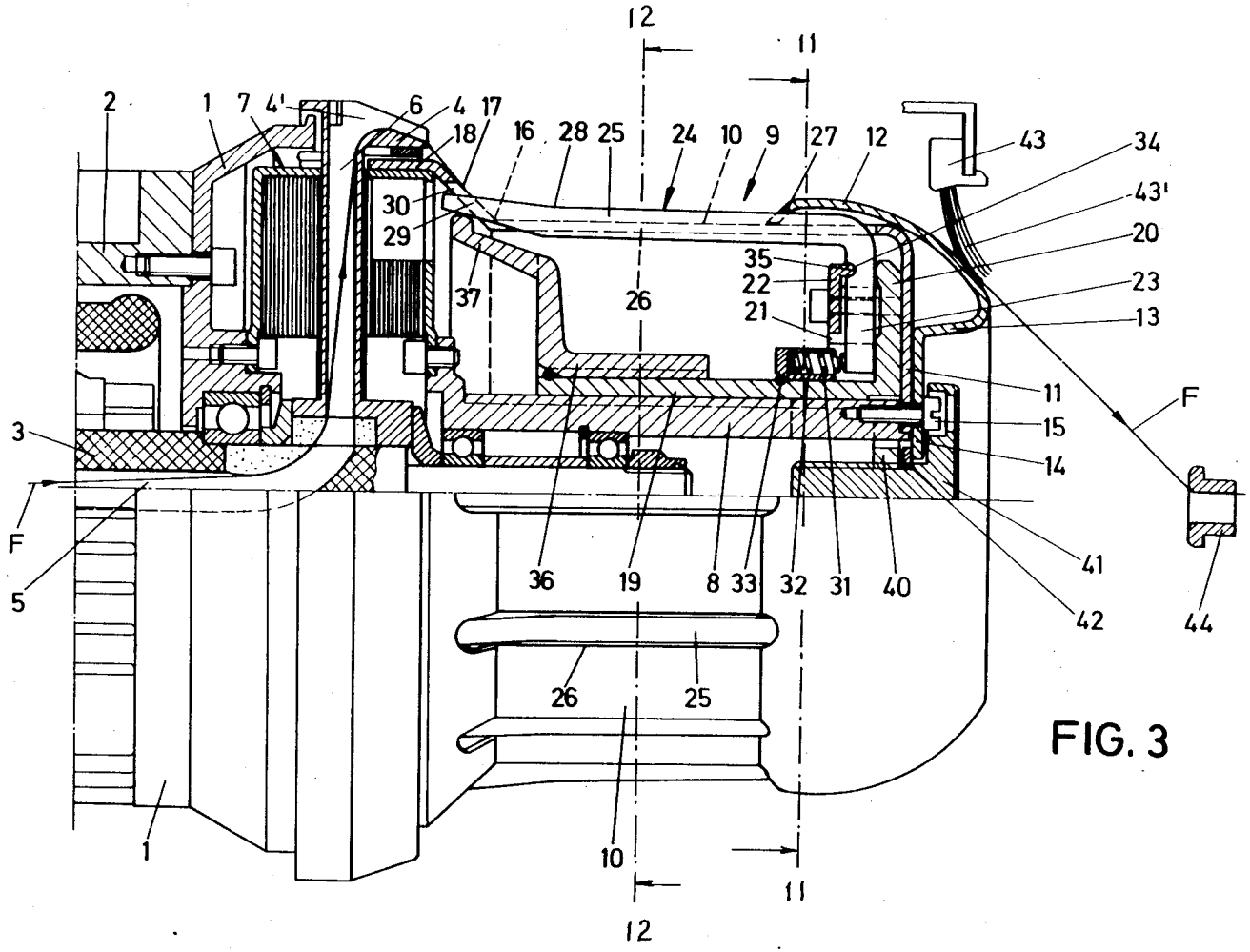
FIG. 3 is a view in approximately true size of the thread storage and feed device, partly in cross section.
Figure 4:
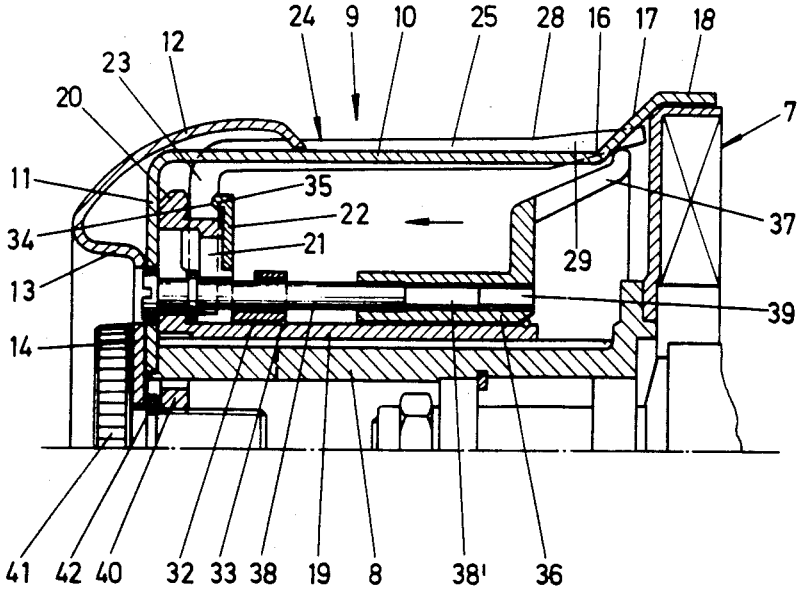
FIG. 4 is a section along the line IV—IV of FIG. 2.
Figure 6:
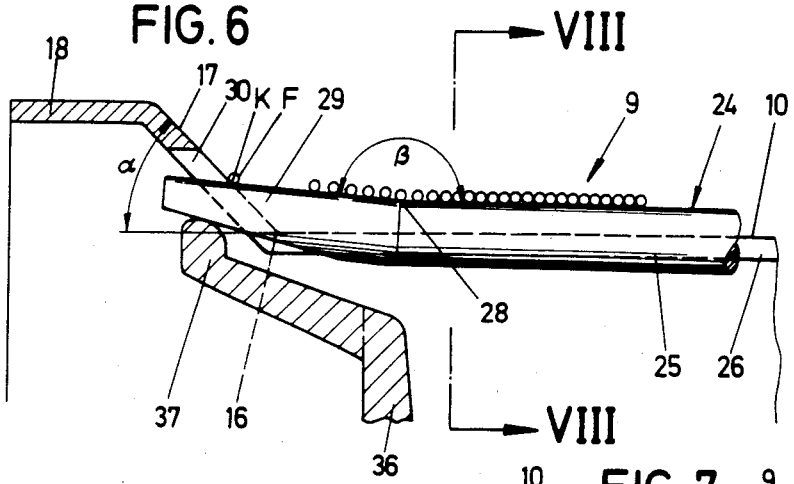
FIG. 6 shows, on a larger scale, a longitudinal section through the winding body in the region of the thread feed point.
Figure 7:
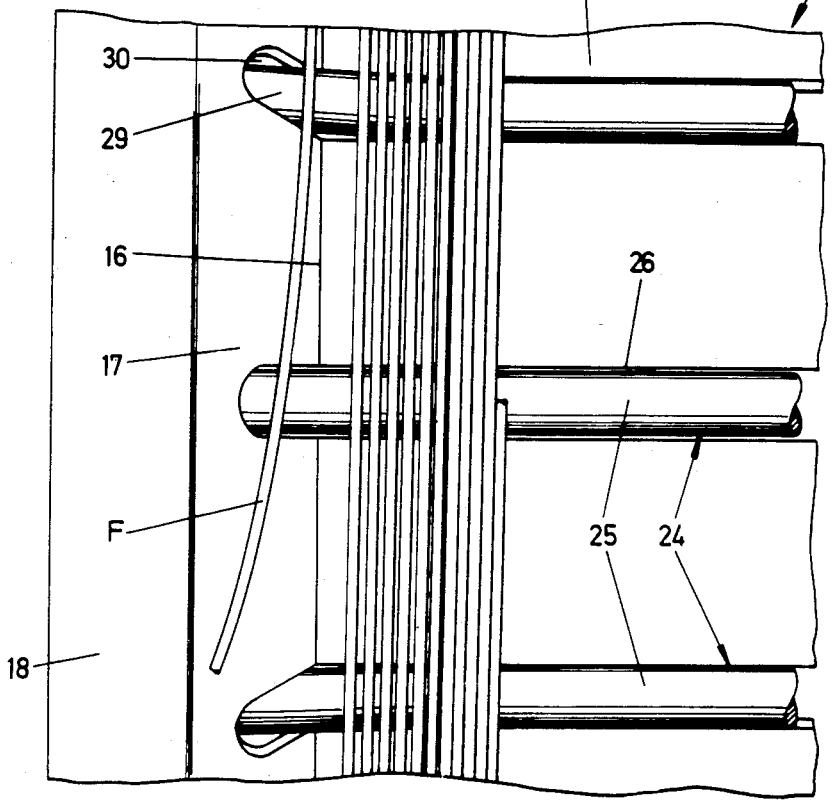
FIG. 7 is a top view of FIG. 6.
Figure 8:
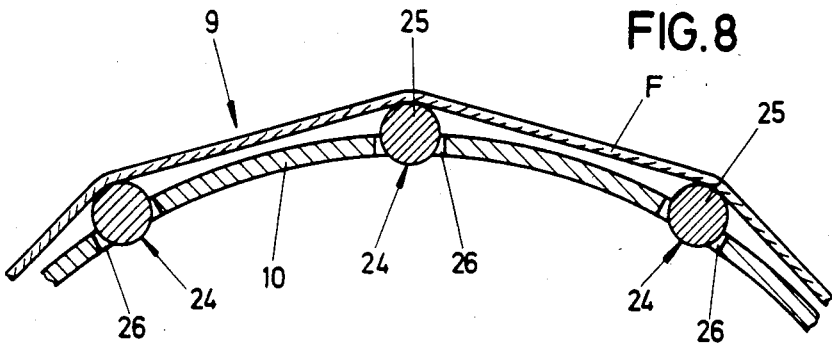
FIG. 8 is a section along the line VIII—VIII of FIG. 6.
Figure 10:
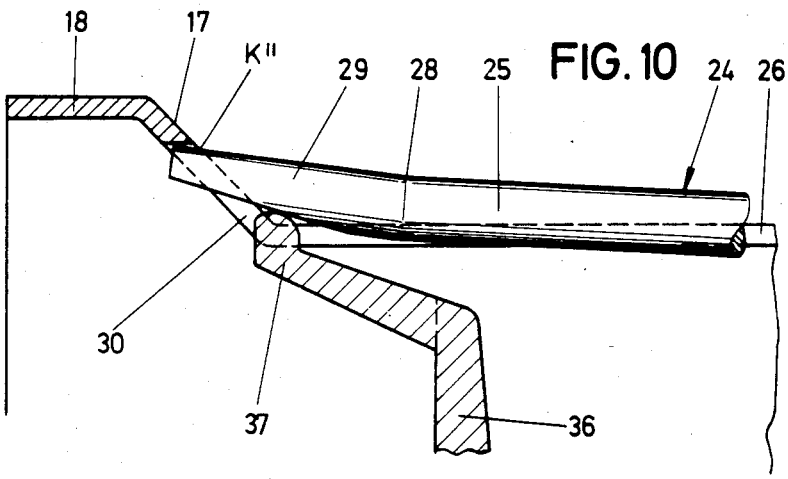
Figure 11:
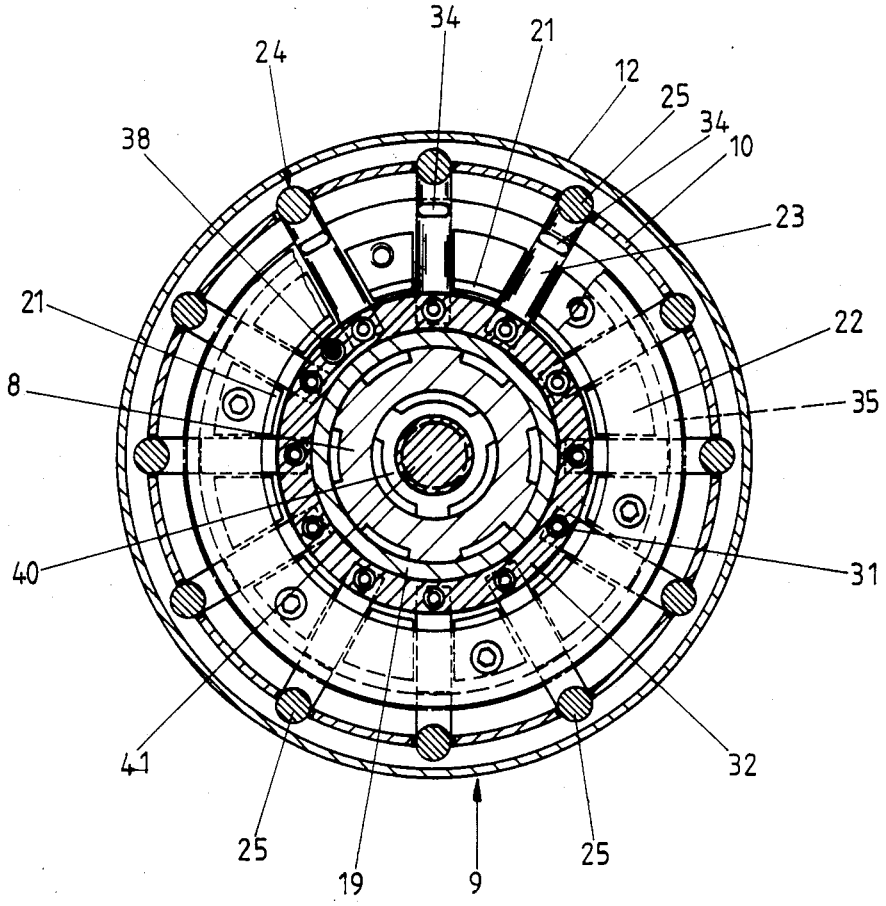
Figure 12:
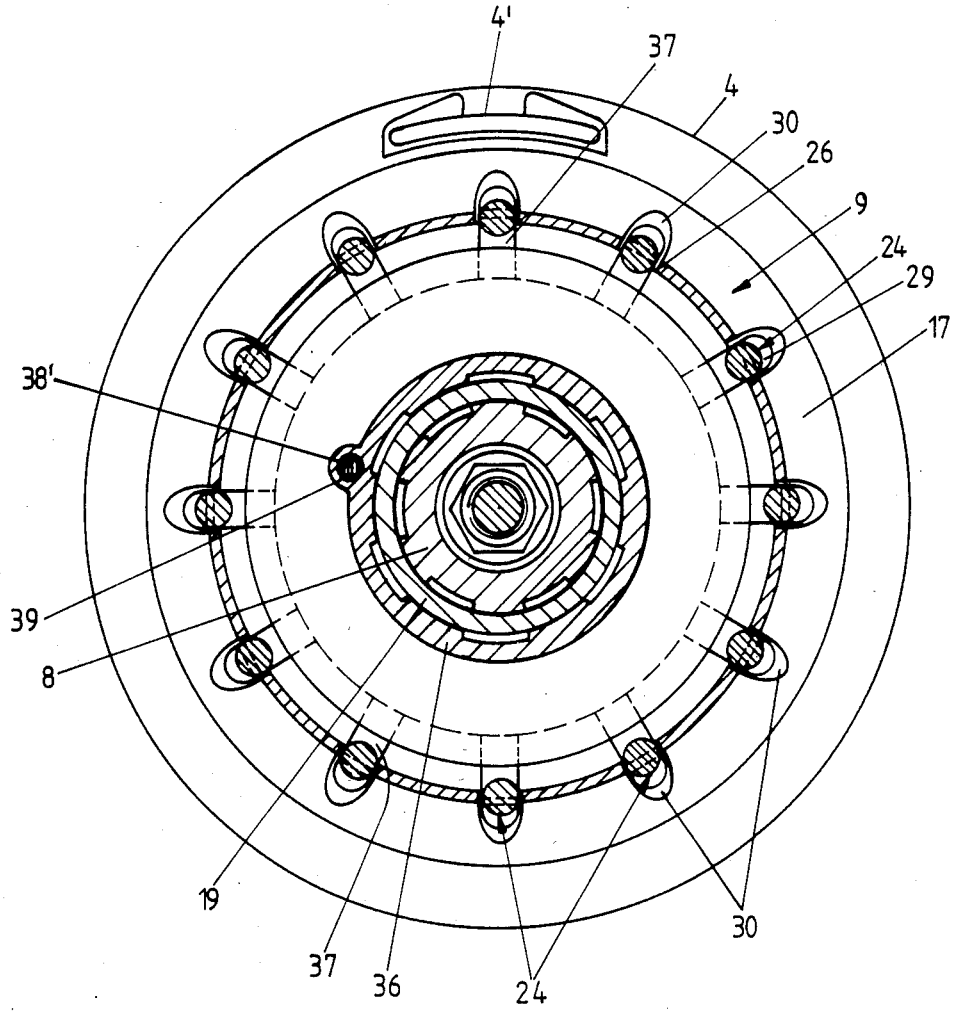

FIG. 10 is also a view corresponding to FIG. 6, in which the arm is swung in radial upward direction as a result of displacement of the sleeve having the finger; and FIGS. 11 and 12 are cross-sections along the lines 11—11 and 12—12 respectively of FIG. 3.

The thread storage and feed device has a drive motor 2 which is flanged onto a housing 1. The shaft 3 of the motor is firmly attached for rotation with a thread-guide support 4. The entering thread F passes into a central channel 5 in the motor shaft 3 and from there into a radial channel 6 in the thread-guide support 4. In the embodiment shown, a braking device, designated generally as 7, is associated with the thread-guide support 4.

The motor shaft 3 continues in axial direction beyond the thread-guide support 4 and is mounted on its protruding portion within a housing bushing 8. The latter is the support for the winding body, designated generally as 9. The winding body 9 comprises, in detail, a circumferential wall 10, developed as a drum, which terminates in an end wall 11 at the withdrawal end of the thread storage and feed device. Said wall rests against the end of the housing bushing 8. The withdrawal end of the cylindrical wall 10 is engaged there by a bulged annular head-surface 12. The latter is converted, via a shoulder 13, into a radially directed end wall 14. Both the end wall 11 of the cylindrical wall 10 and the end wall 14 of the annular head-surface 12 are held on the housing bushing 8 by screws 15 and thus are non-turnable.

The free end of the circumferential wall 10 passes via an angular channel 16, into a conical widened portion 17. The angle of inclination alpha of this conical widened portion is 45° in the embodiment shown; see in particular FIG. 6. Adjoining the conical widened portion 17 there is a section 18 which extends axially parallel and is engaged thereover by the thread-guide support 4.

A bushing 19 is mounted for axial displacement on the housing bushing 8, said bushing 19 terminating at the withdrawal end of the winding body 9 in a radially directed flange 20. Parallel to the flange 20 is a flange plate 22 which rests on spacers 21 of the flange 20. In this way, hollow spaces between flange 20 and flange plate 22 are created equal angularly apart to receive radially bent ends 23 of approximately parallel arms 24 of the winding body 9. The parallel extending section 25 of the arms 24 is disposed partially in grooves 26 in the drum wall 10 and extends beyond said wall. As can be noted from FIG. 3, the ends of the parallel extending arms 24 engage in cutouts 27 in the annular head surface of the winding body 9.

The arms 24, which extend approximately over the entire axial length of the winding body 9, form angular channels 28 of their own at the ends thereof facing the angular channel 16. Their channel angle beta is about 176°. The region 29 of the arms 24 which adjoins the angular fillet 28 engages into slots 30 in the conical widened portion 17 which extend from the grooves 26. In one end position of the arms—see FIGS. 3 and 6—the regions 29 of the arms 24 are in extracted position. In this position, the flange 20 of the bushing 19 rests against the inner side of the end wall 11 of the circumferential wall 10; see FIG. 3.

The angularly bent ends 23 of the arms 24 are acted on by compression springs 31. These springs are seated in bores of a sleeve 32 non-rotatably mounted on the bushing 19. Axial displaceability of the sleeve 32 in one direction is prevented by a stop ring 33. In the basic position, the ends 23 rest against the flange 20. The ends 23 are provided with a channel 34. A projection 35 on the flange plate 22 extends in form-locked manner into said channel. Furthermore, a sleeve 36 which is arranged displaceably on the bushing 19 effects the stop-limited end position on the arms 24; a number of radially directed fingers 37 corresponding to the number of arms 24 extend from said sleeve, the end regions 29 of the arms 24 resting on said fingers.

The flange 20 of the bushing 19 carries a screw 38 which is accessible from the head surface of the winding body 9. This screw is held non-displaceably in axial direction within the flange 20. Its thread 38' engages into an internal thread 38 of the sleeve 36 which, in its turn, is arranged displaceably on the bushing 19. If the screw 38 is now turned in such a manner that, for instance, the sleeve 36 comes into the dash-dot position of FIG. 5, this leads to a swinging of the arms 24 in the direction in opposition to their spring load, the projection 35 of the flange plate 22 forming the pivot point.

The bushing 19 with its arms 24 can also be displaced as a single unit on the housing bushing 8. For this purpose, the flange 20 is connected by arms with a collar 40 which forms a corresponding internal thread. An adjustment screw 41 in the center of the head surface of the winding body 9 engages into said internal thread and produces the longitudinal displaceability. A lock ring 42 insures that the adjustment screw 41 is fixed in axial direction on the end wall 14. Therefore, when the adjustment screw 41 is turned, this leads to displacement in axial direction of the bushing 19 with the arms 24 seated thereon.

A control device which operates mechanically or in the manner of a light gate monitor can be associated with the winding body 9, its object being to scan the supply of turns on the winding body 9 and so control the drive that a predetermined supply of turns is, for instance, always present on the winding body.

In the embodiment shown as example, the annular head surface 12 has, associated with it, a damping ring 43 shown diagrammatically in FIG. 3, the bristles 43' of said ring pressing against the annular head surface.

Upon the application of the layers of yarn courses, the thread F leaving the thread guide 4' passes, first of all, onto the conical widened portion 17 and from there into the channel K between the region 29 of the arms 24 and the conical widened portion 17. The region of the conical widened portion which is located between the region 29 of the arms accordingly forms a feed section for the thread F placed thereon. In this way, thread courses are placed on the regions 29 of the arms 24 which are tapered in the direction towards the withdrawal end. In FIGS. 3 and 6, there is a basic position of the arms such that a slight tapering of the arms 29 towards the withdrawal end is furthermore present adjoining the fillets 28. The layers of thread are accordingly applied onto a polygonal winding body which is formed by the arms 24. The withdrawal end of the thread F slides over the annular head surface 12 and passes through the damping ring 43, from where the thread F passes through a central bushing 44.

Figure 9:
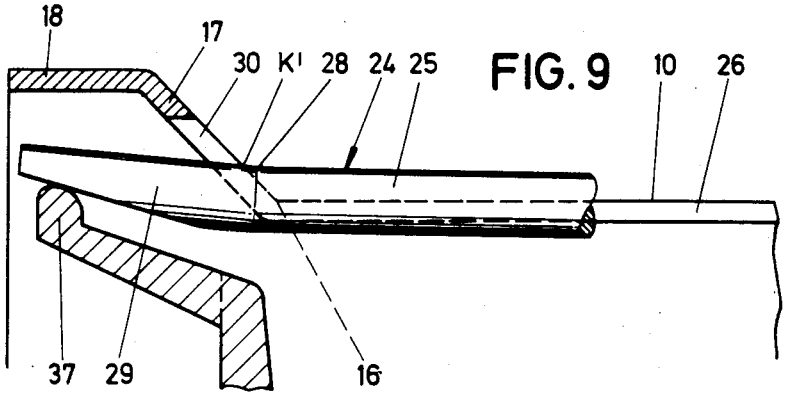
FIG. 9 is a view, corresponding to FIG. 6, in which the angular channel region of the arm is introduced by longitudinal displacement into the slot.

If a less elastic thread is to be stored on the thread storage and feed device, then the bushing 19 is displaced in axial direction by means of the adjustment screw 41, the regions 29 of the arms 24 entering into the slots 30 of the conical widened portion; see FIG. 9. Accordingly, the courses of thread, after application onto the conical widened portion, come directly onto the section 25 of the arms 24 without the regions 29 being in action. At the same time, the channel K′ shifts between the conical widened portion 17 and arms 24 in the direction towards the angular channel 16, creating different conditions for the application of the thread onto the conical widened portion 17.

If, on the other hand, highly elastic threads are to be used, then the screw 38 is turned, together with a displacement of the sleeve 36, the arms 24 being swung radially outwardly via the fingers 37; see FIG. 10. The channel K″ thereby changes its position. Furthermore, the taper of the arms in the direction of withdrawal is greater, which favors the advance of the thread, particularly in the case of these highly elastic threads, while the passing of the layers of thread over one another is prevented as a result of the elasticity of the threads.

Figure 5:
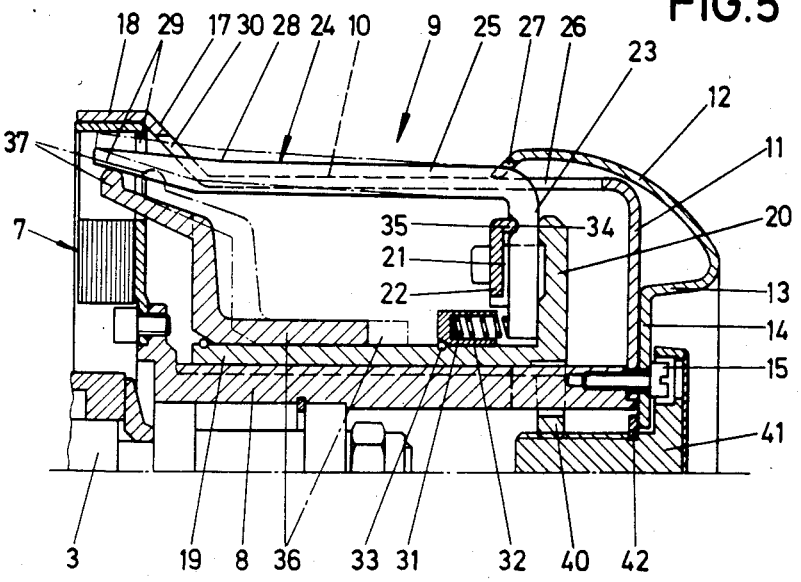
FIG. 5 shows the winding body, partially in cross section, with the bushing displaced.

In the case of certain yarns, however, it is also possible to select the dash-dot position of the arms 24 shown in FIG. 5. Extensive adaptation to different grades of yarn is therefore possible.

I claim:

1. In a thread storage and feed device having a winding body to which the thread is fed in a region of a conical widened portion of the winding body to form a supply which is removable therefrom, said winding body defining an axis and having an axial length, arms being arranged cross-wise to a first angular channel of the conical widened portion, said arms extending into slots respectively formed in the region of the conical widened portion of the winding body and being directed towards corners of a polygon, the improvement wherein each of said arms extends substantially over the axial length of the winding body and is longitudinally displaceable in axial direction of said winding body, each of said arms forms a second angular channel at an end thereof facing the first angular channel, a region of said end being insertable into a respective of said slots by longitudinal displacement of said each arm.

2. The thread storage and feed device according to claim 1, wherein said end of the arms is radially adjustable.

3. The thread storage and feed device according to claim 1, wherein said winding body has a circumferential wall formed as a drum, an other end of said arm, located at a thread-withdrawal side of the winding body is swingably mounted on the winding body, each said arm has a section which faces said other end, said section extends approximately parallel to said circumferential wall of the winding body.

4. The thread storage and feed device according to claim 3, wherein said circumferential wall is formed with grooves extending from said slots respectively, said sections extend in parallel and are disposed partially in said grooves.

5. The thread storage and feed device according to claim 3, wherein said circumferential wall is formed with grooves extending from said slots, respectively, said other ends of said arms are on the sections and are partially disposed in said grooves, respectively.

6. The thread storage and feed device according to claim 3, wherein said winding body is formed with a slightly bulged annular head surface at said other ends of said arms, said circumferential wall of said drum is formed with grooves extending from said slots, respectively, said other ends of said arms are on the sections and extend into said bulged annular head surface of the winding body.

7. The thread storage and feed device according to claim 1, wherein said winding body at a thread-withdrawal end has a head surface, means comprising an adjustment screw mounted in the center of the head surface of the winding body and operatively cooperating with said arms for effecting the longitudinal displaceability of said arms.

8. The thread storage and feed device according to claims 1, wherein said winding body at a thread-withdrawal end has a head surface, means comprising a screw, accessible from the head surface of the winding body, for adjusting said arms in a radial direction.

9. The thread storage and feed device according to claim 1, further comprising a bushing longitudinally displaceably mounted within said winding body, a sleeve is displaceable concentrically on the bushing and has fingers, said arms are seated collectively, swingable against spring biasing on said bushing and rest on said fingers of said sleeve.

10. The thread storage and feed device according to claim 1, wherein said second angle channel forms a channel angle of the arms of about 176°, and the first angle channel forms a channel angle of the conical widened portion of about 45°.

* * * * *